US008496140B2

(12) United States Patent
Rothen

(10) Patent No.: US 8,496,140 B2
(45) **Date of Patent: *Jul. 30, 2013**

(54) PISTON WIPER PLATE FOR PRESSING UNITS FOR MELTING SYSTEMS FOR BAGS AND MELTING SYSTEM FOR BAGS PROVIDED WITH SAID PISTON WIPER PLATE

(75) Inventor: Michael Rothen, Langenfeld (DE)

(73) Assignee: Illinois Tool Works, Inc., Glenview, IL (US)

( * ) Notice: Subject to any disclaimer, the term of this patent is extended or adjusted under 35 U.S.C. 154(b) by 384 days.

This patent is subject to a terminal disclaimer.

(21) Appl. No.: 12/745,392

(22) PCT Filed: Nov. 28, 2008

(86) PCT No.: PCT/EP2008/010135

§ 371 (c)(1),
(2), (4) Date: May 28, 2010

(87) PCT Pub. No.: WO2009/068311

PCT Pub. Date: Jun. 4, 2009

(65) Prior Publication Data

US 2010/0308080 A1 Dec. 9, 2010

(30) Foreign Application Priority Data

Nov. 28, 2007 (DE) ..... 20 2007 016 706 U

(51) Int. Cl.
*B65D 35/28* (2006.01)

(52) U.S. Cl.
USPC ..... 222/95; 222/146.2; 222/342; 222/386

(58) Field of Classification Search
USPC ..... 222/95, 146.2, 146.5, 342, 386; 92/200, 92/215; 277/471, 931, 932
See application file for complete search history.

(56) References Cited

U.S. PATENT DOCUMENTS

| | | | | |
|---|---|---|---|---|
| 3,918,355 | A * | 11/1975 | Weber | 99/283 |
| 4,090,640 | A * | 5/1978 | Smith et al. | 222/52 |
| 4,231,492 | A * | 11/1980 | Rios | 222/1 |
| 4,355,734 | A * | 10/1982 | Moore | 222/63 |
| 4,953,739 | A * | 9/1990 | Wooge et al. | 222/326 |
| 5,301,835 | A * | 4/1994 | Fulks et al. | 222/95 |
| 6,685,063 | B2 | 2/2004 | Brugner | |

FOREIGN PATENT DOCUMENTS

| | | |
|---|---|---|
| DE | 3021522 | 1/1982 |
| DE | 20117778 | 4/2003 |
| DE | 10313051 | 10/2004 |

(Continued)

*Primary Examiner* — Kevin P Shaver
*Assistant Examiner* — Daniel R Shearer
(74) *Attorney, Agent, or Firm* — Rankin, Hill & Clark LLP

(57) ABSTRACT

A piston wiper plate for a pressing unit for melting systems for bags includes a single-piece wiper plate having an axial upper side and an axial bottom side made of elastically resilient material, and a radially outer wiper edge that surrounds the periphery in the relaxed state. The sealing and sliding properties thereof remain within a predetermined range even when the temperatures fluctuate more drastically in that in the wiper plate includes at least one recess that is inserted in the axial upper side and/or in the axial bottom side and/or between the axial upper and bottom sides thereof and that allows for at least a radial compression of the wiper plate. At least one expandable restoring element can be inserted into the recess.

7 Claims, 3 Drawing Sheets

FOREIGN PATENT DOCUMENTS

| | | |
|---|---|---|
| EP | 0031052 | 7/1981 |
| EP | 0245210 | 11/1987 |
| EP | 0281755 | 9/1988 |
| EP | 1213036 | 6/2002 |
| WO | 2007/054233 | 5/2007 |
| WO | 2007/118907 | 10/2007 |

* cited by examiner 10
12C
12C'
12B
12A,
12E
20
24C
22
24
28
24B
24A
40
30
26
28
14
14A
12D
40A
14A 24C
22
28
24
20
12C
12C'
10
24B
24A
12
26
18A
26A
12A,
12E
16
12B
18
18D
30
40
16A
18C
12D
18B
14A
14
14A
40A

PISTON WIPER PLATE FOR PRESSING UNITS FOR MELTING SYSTEMS FOR BAGS AND MELTING SYSTEM FOR BAGS PROVIDED WITH SAID PISTON WIPER PLATE

This application claims priority to and the benefit of the filing date of International Application No. PCT/EP2008/010135, filed 28 Nov. 2008, which application claims priority to and the benefit of the filing date of German Application No. 20 2007 016 706.7, filed 28 Nov. 2007, both of which are hereby incorporated by reference into the specification of this application.

FIELD OF THE INVENTION

The present invention generally relates to a plunger stripper plate for a pressing unit for melting systems for bags comprising a single-piece stripper plate having an axial upper side and an axial bottom side made of elastically resilient material, comprising a radially outer wiper edge that surrounds the periphery of the stripper plate in the relaxed state.

TECHNOLOGICAL BACKGROUND

Melting systems for bags convert a solid working material packaged in a packaging bag, such as a hot melt adhesive, from its initial solid to a flowable state by heating it in a cylindrical receiving chamber of a pressing unit while a pressing plunger is advanced in the receiving chamber from the rear bag end so that molten working material is pressed out and the packaging bag is gradually compressed in axial direction along the cylindrical wall of the receiving chamber. The pressing plunger is provided with a stripper plate to facilitate low-friction backward reloading of new filled packaging bags without a major cleaning effort. It primarily has a sealing function towards the inner cylinder wall and serves as stripper for any working material that may adhere to the inner cylinder wall that undesirably came between the outside of the packaging bag and the inner side of the cylinder wall. A low friction value between the stripper plate and the inner cylinder wall is desired to allow a precisely predefined discharge quantity, i.e. dosage, of the molten working material. For these and other reasons, a preferred stripper plate is typically made of an elastically resilient material such as a plastic, in particular, PTFE (such as Teflon®) and the cylindrical inner wall is also coated with a similar low-friction sliding material. Varying processing temperatures, in particular hot and cold zones in a bag melting system, result in varying calibers of the stripper plate in proportion to the respective temperature. It is therefore difficult, especially in bag melting systems, to ensure uniform force and sealing conditions between the stripper plate and the cylindrical inner wall over the entire pressing path.

SUMMARY OF THE INVENTION

It is therefore the problem of the invention to change a plunger stripper plate in such a way that its sealing and sliding properties remain within a predefined range even if temperatures vary greatly. This problem is solved by proposing an exemplary stripper plate that has at least the characteristics listed in claim 1. According to an exemplary embodiment of the present invention, at least one recess that allows radial compression of the stripper plate is inserted in the axial upper and/or axial bottom side and/or between the axial upper and the axial bottom side of the stripper plate, and that an expandable return element can be or is inserted in the at least one recess.

According to the invention, thermal expansion of the stripper plate does not just occur in radial outward direction. Instead, the recesses according to the invention that typically are openings between the upper and bottom sides of the stripper plate have the effect that the reaction forces of thermal expansion result in a volume reduction of the recesses. However, the stripper plate still retains adequate radial expansion capacity to compensate for any temperature-related radial expansion of the inner cylinder wall. A "memory effect" is typically not present in the common materials used for stripper plates. According to one exemplary aspect, an expandable return element can be or is inserted in the at least one recess to prevent that a stripper plate installed in the cylinder misses, i.e. fails to return to, its nominal size after thermal deformation of the at least one recess. The combination of elastically resilient recesses of the stripper or working plate [sic] and expandable return elements has the effect that the exemplary stripper plate according to the present invention can reliably fulfill its intended function even after a large number of temperature change cycles. It is possible to use the exememplary stripper plate according to the invention in various ways, and in particular to form the recesses in many different ways and to use the most varied return elements:

If the one or the several recess(es) is/are incorporated radially into the exemplary stripper plate, a particularly high measure of radial expansion or radial compression can be achieved. According to one aspect, the segments of the stripper or working plate separated by the radially extending recesses remain contiguous at the outer radial rim. A radial interruption of the stripping edge as is common with piston rings of internal combustion engines is thus expendable.

Preferred materials for the return elements are rubber-elastic materials; although, like material are also contemplated. According to an exemplary embodiment of the invention, the return elements are designed with about the same shape as their associated recesses and can comprise a specific oversize in proportion to the recess in the stripper plate. This does not only ensure a simple and safe hold of the expandable return element in the recess but also twists the stripper plate radially outwards to a certain extent.

The slide-in opening of the cylindrical receiving chamber for the plunger that is carrying the stripper plate comprises a generally conical insertion area so that stripper plates with a certain oversize can be used.

The components to be used according to the invention as mentioned above and as claimed and described in the embodiments are not subject to special selection constraints regarding their size, shape, material, and engineering design so that the selection criteria known in the field of application can be applied without limitation.

Further details, characteristics, and advantages of the subject matter of the invention result from the subordinate claims as well as from the description of the associated figure and table showing an embodiment of a plunger stripper plate as an example.

DETAILED DESCRIPTION OF AN EMBODIMENT

Figure 2:
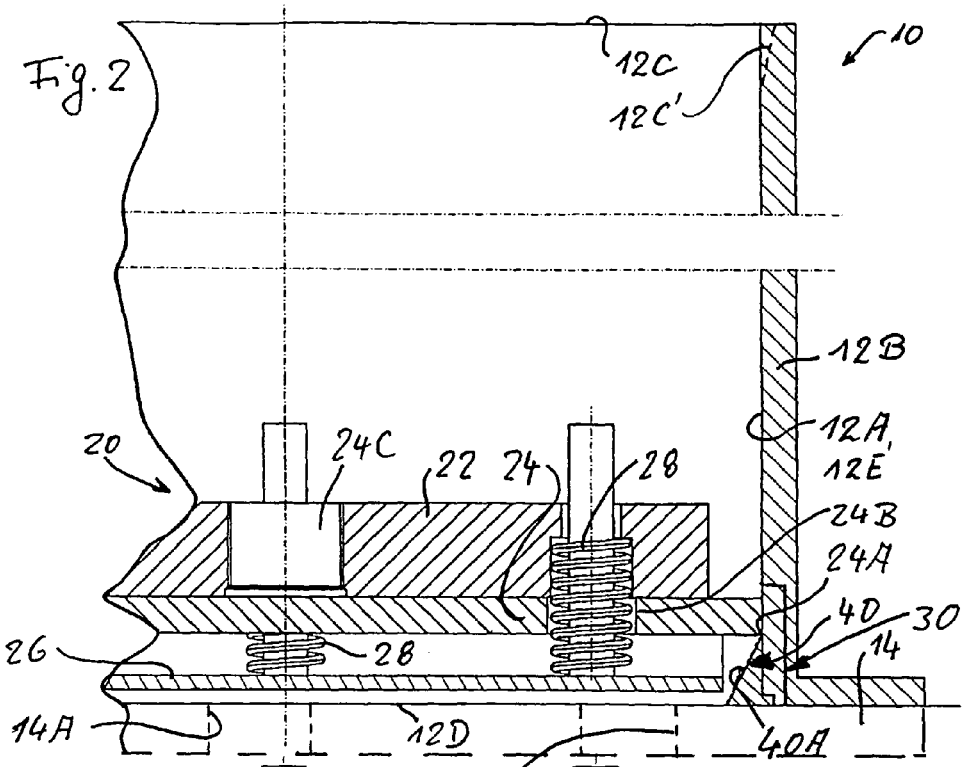
FIG. 2 shows the same device after pressing the molten working material out of the packaging bag.
Figure 1:
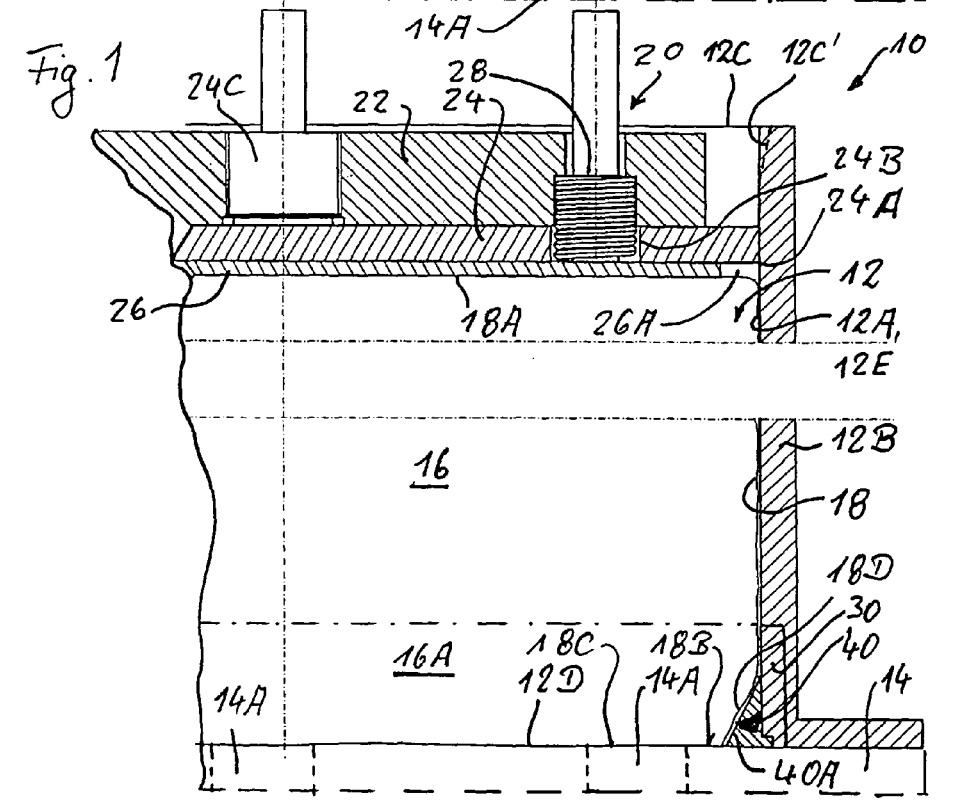
FIG. 1 shows a semilateral axial view of a bag melter with a freshly inserted and filled packaging bag.

Referring now to the drawings wherein the showings are for the purpose of illustrating preferred and alternative embodiments of the present invention only and not for the purpose of limiting same, a bag melter 10 is shown in two operating positions in FIGS. 1 and 2. The bag melter 10 includes a receiving chamber 12 surrounded by a cylindrical inner wall 12A. The wall 12B that encloses the receiving chamber 12 forms opposite outlet ends 12C and 12D at its upper and lower ends in operating position. The lower outlet end 12D is closed with an end plate 14 that comprises multiple discharge openings 14A. A packaging bag 18 tautly filled with a hot melt adhesive 16 is located inside the receiving chamber 12 (FIG. 1). The packaging bag is tightly sealed on its back end 18A that is shown in top position in the figure, and completely open on its bottom front end 18B, forming the discharge opening 18C. The packaging bag 18 tautly filled with solid working material is typically opened directly before it is inserted from top to bottom, i.e. from the upper outlet end 12C, into the receiving chamber 12. The pressing device 20 for the packaging bag 18 can be adequately removed for this purpose.

The pressing device 20 includes a pressing plunger 22 that can be moved in an axial direction within the receiving chamber 12. The pressing plunger 22 comprises a scraper or stripper plate 24 (e.g. made of PTFE, e.g. Teflon®) and has a sharp-edged circumferential scraping edge 24A. Low-loss sliding of the pressing plunger 22 along the cylinder wall and thus a fairly accurately defined pressure onto the molten working material 16A can be realized in the region of the lower heating zone in combination with an interior coating 12E of the wall 12B of the receiving chamber 12. The interior coating of the wall can be a PTFE coating.

The receiving chamber 12 comprises a ring-like constriction 40 in the region of its lower outlet end 12D. In the exemplary embodiment shown here, it has the shape of a ring that can be detachably inserted into the lower outlet end of the wall 12B of the receiving chamber 12. It has a tapered wall on the side facing the receiving chamber 12 that serves as sealing surface 40A. It has a self-centering effect on the packaging bag 18 when the bag is inserted into the receiving chamber 12. As soon as the heating element 30 causes melting in the region 16A of the working material 16, the edge zone 18D of the packaging bag 18 automatically comes to rest against the tapered sealing contact surface 40A. The lateral pressure exerted by the working material expanding under the pressure onto the edge zone 18D is typically sufficient to achieve this.

The pressing plunger 22 is further equipped with a head plate 26 that is connected to the pressing plunger 22 via pressure or compression springs 28 that are conducted through the scraping plate 24. The cross sectional surface of the head plate is smaller than the one of the scraping plate 24 in such a way that there remains a gap 26A between the outer rim of the head plate and the cylinder wall 12A of the receiving chamber 12. This gap 26A is dimensioned to allow penetration of the head plate 26 into the zone with a constricted cross section on the lower outlet end of the receiving chamber 12 by a definable length. The compression springs 28 are compressed by the pressure of the pressing plunger in the working position shown in FIG. 1. If however the packaging bag 18 is almost empty and the remaining working material in it has been liquefied, the pressure of the springs 28 is sufficient to move the head plate into the constriction area and press the last remnants of working material out of the packaging bag although the scraping plate 24 does not come down any further but stops in front of the constriction 40.

Figure 3A:
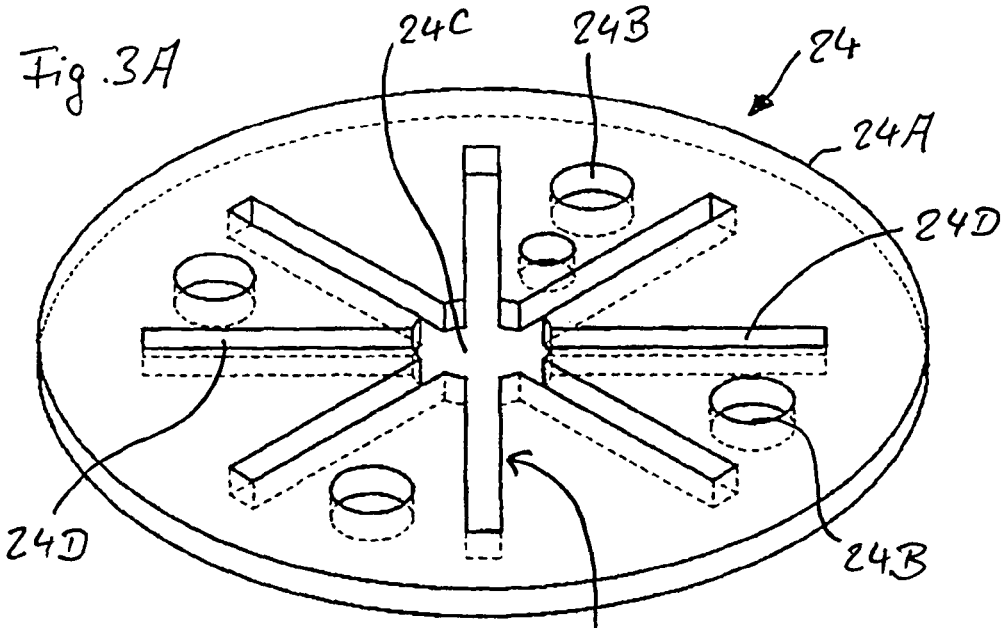
FIG. 3A/B shows a top view of an exemplary stripper plate of the bag melter according to FIGS. 1 and 2.

FIG. 3A shows a top view of the exemplary scraping or stripper plate 24 on which four openings 24B are visible around its perimeter for the compression springs 28. In addition, there is a central opening 24C from which eight recesses 24D extend in radial direction. This makes the scraping or stripper plate 24 somewhat deformable, e.g. it can be compressed by radial pressure towards the center and/or expanded radially outwards. If a scraping or stripper plate designed in this way is pressed into the receiving chamber 12 using an insertion cone 12C' at the upper outlet end 12C, the scraping edge 24A sits tightly against the cylindrical inner wall 12A of the receiving chamber 12. If the cross section of the receiving chamber 12 expands by heating in the region of the heating component 30, the cross section of the scraping or stripper plate 24 can follow suit with this expansion.

Figure 3B:
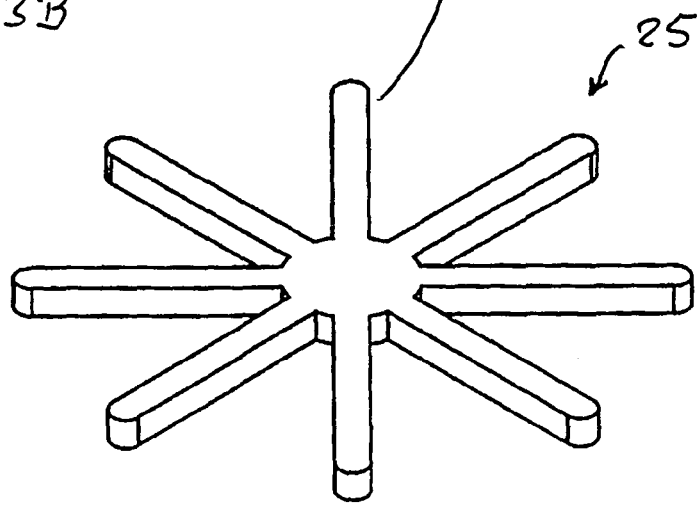

Due to the potentially large coefficient of thermal expansion of the scraping or stripper plate 24 as compared to the coefficient of thermal expansion of the wall 12B of the receiving chamber 12, it can be advantageous to design the scraping or stripper plate 24 with a nominal diameter that matches the nominal diameter of the cylindrical inner wall 12A of the receiving chamber 12 fairly exactly. To obtain good stripping results if the scraping or stripper plate 24 is increasingly heated up by the heating element 30, it can be advantageous that an expandable return element is inserted into the recess 24C, 24D. Such an element is shown in FIG. 3B and may, for example, be made of a rubber-elastic material. The outcome is that the scraping or stripper plate 24 can more easily expand again after initial radial compression when the inward radial forces decrease and/or that the scraping or stripper plate 24 can be returned to its original cross section after initial radial expansion due to the inserted return element 25 because of radial compression forces applied from outside. In general, a scraping or stripper plate 24 designed in that way and representing an inventive step in its own right helps keep the inner cylindrical wall 12A of the receiving chamber 12 clean and produces a particularly good sealing effect without damaging the antifriction coating 12E of the receiving chamber 12.

It is understood that the exemplary stripper plate according to the present invention can be successfully used with a multitude of pressing devices and a multitude of different working materials. Working materials need not necessarily be present in solid form and meltable and/or packaged in a packaging bag. Rather, a working material that is a paste at room temperature can be processed with the device according to the invention as well. Similarly, recesses for absorbing compression and return elements in the meaning of the invention can also be varied in multiple ways.

Figure 4B:
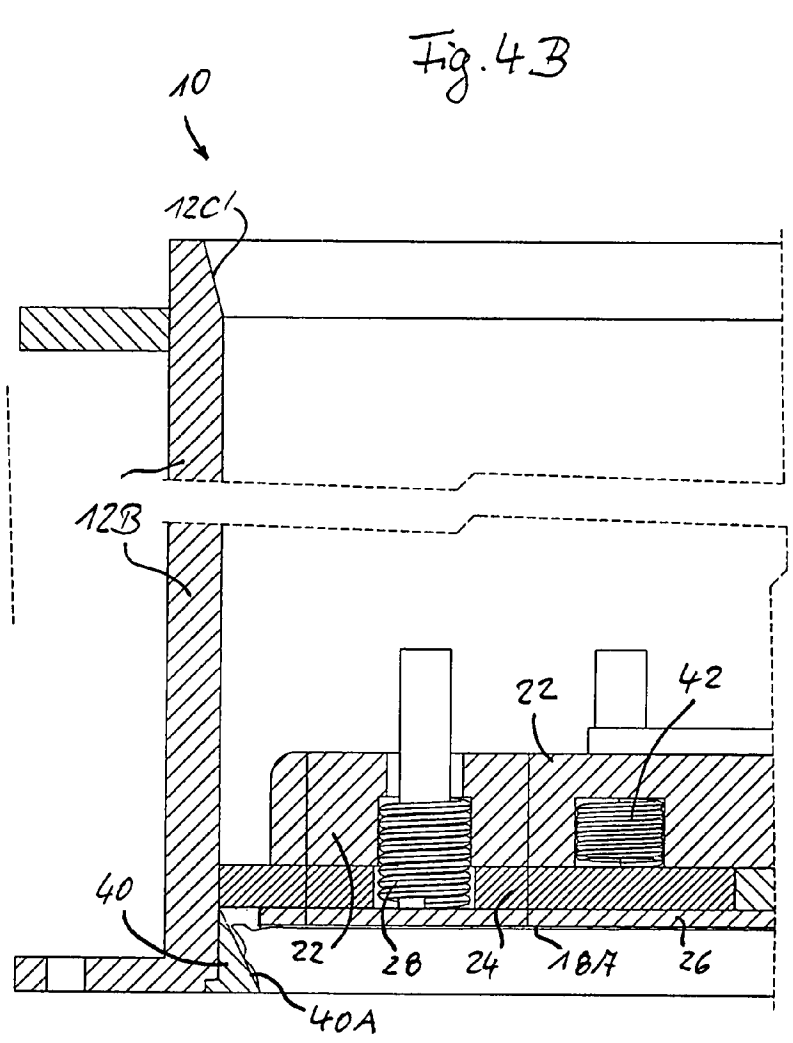
FIG. 4A/B shows an alternative exemplary embodiment with spring-supported scraping or stripper plate in pressureless or compressed state, respectively.
Figure 4A:
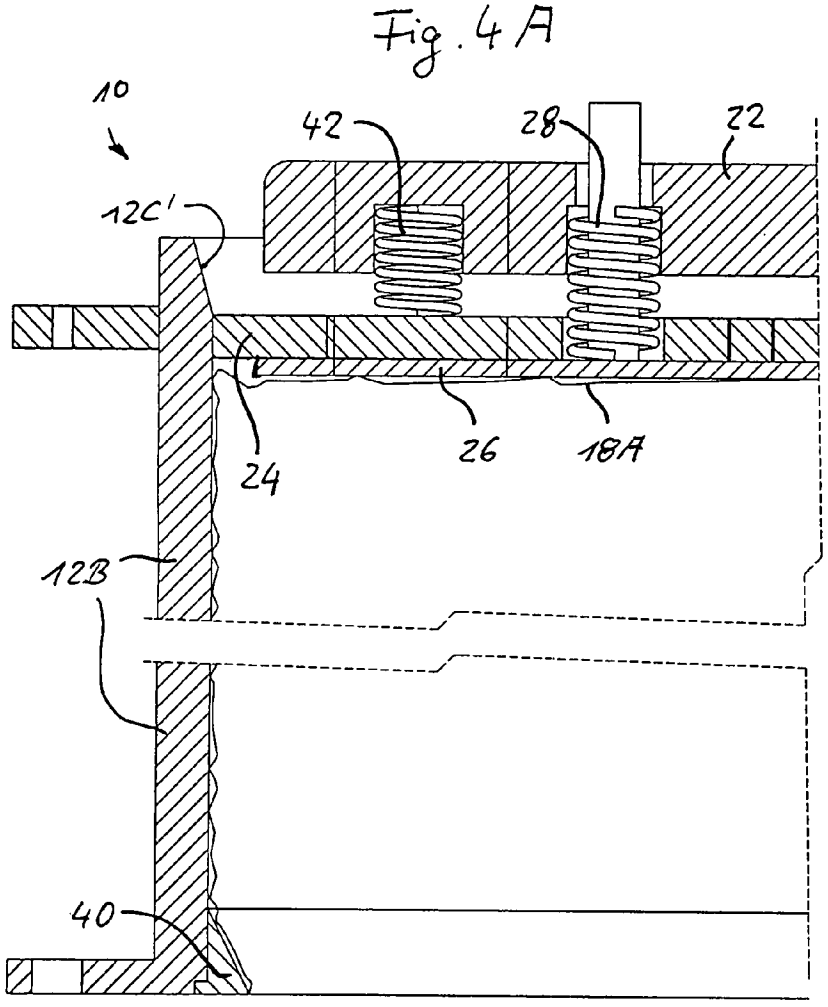

In the alternative embodiment according to FIGS. 4 A/B, compression springs 42 are provided between the pressing plunger 22 and the scraping or stripper plate 24 so that they hold the scraping or stripper plate 24 at an axial spacing from the pressing plunger when expanded in the pressureless state (FIG. 4A). In the compressed state shown in FIG. 4B, the plunger pressure of the pressing plunger 22 is transferred to the scraping or stripper plate 24 in that it rests against it.

As is evident from the foregoing, the melting system includes the cylindrical receiving chamber 12 and the pressing unit 20 in the form of the pressing plunger 22 with a plunger stripper plate that can be moved in axial direction within the receiving chamber. The feeding cone 12C' is located at a feeding inlet of the cylindrical receiving chamber 12 for a working material 16 that can be pressed out of the receiving chamber. The plunger stripper plate for the pressing unit 20 comprises the single-piece stripper plate 24. The exemplary stripper plate 24 has the axial upper side 24' and axial bottom side 24" made of elastically resilient material, and a radially outer wiper edge 24A that surrounds the periphery of the stripper plate in the relaxed state. The stripper plate further comprises at least one recess 24C, 24D that allows at least radial compression of the stripper plate inserted in its axial upper side and/or in its axial bottom side and/or between its axial upper and bottom sides, and in that at least one expandable return element 25 is or can be inserted into the recess 24C, 24D. According to one aspect, the at least one recess 24C, 24D is radial. The recesses provide for radially extending circular segments separated from each other by spacings but contiguous at their radial outer rim. According to another aspect, the at least one return element is generally identical in shape with the at least one recess and is made of a rubber elastic material.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

LIST OF REFERENCE SYMBOLS

| | |
|---|---|
| 10 | Bag melter |
| 12 | Receiving chamber |
| 12A | Cylindrical inner wall |
| 12B | Wall |
| 12C | Upper outlet end |
| 12C' | Insertion cone |
| 12D | Lower outlet end |
| 12E | Interior coating |
| 14 | End plate |
| 14A | Outlet openings |
| 16 | Hot-melt adhesive |
| 16A | Molten hot melt adhesive |
| 18 | Packaging bag |
| 18A | Back end |
| 18B | Front end |
| 18C | Discharge opening |
| 18D | Edge zone |
| 20 | Pressing device |
| 22 | Pressing plunger |
| 24 | Scraping or stripper plate |
| 24A | Scraping edge |
| 24B | Openings |
| 24C | Central openings |

-continued

LIST OF REFERENCE SYMBOLS

| | |
|---|---|
| 24D | Radial recesses |
| 25 | Expandable return element |
| 26 | Head plate |
| 26A | Gap |
| 28 | Pressure spring |
| 30 | Heating element |
| 40 | Constriction |
| 40A | Tapered sealing contact surface |
| 42 | Compression Springs |

The invention claimed is:

1. A rearwardly reloadable bag melting device comprising:

a cylindrical receiving area having an ejection opening, and an ejection pressing device axially movable inside the receiving area toward the ejection opening, the ejection pressing device in the form of an ejection piston with a piston stripping plate made of elastically resilient material, the stripping plate having an axial upper side and an axial lower side, a radially outer stripping edge that runs tightly around the stripping plate in an unstressed state, the bag melting device further including an ejection-side heating zone for melting the solid working material in the area of the ejection opening, wherein the stripping plate includes at least one of a recess in at least one of the axial upper side and the axial lower side and a through-hole opening extending between the axial upper and the axial lower side, the at least one recess and opening enabling at least a radial compression of the stripping plate, the stripping plate further including at least one expandable restoring element that is insertable into the at least one recess and opening.

2. The bag melting device according to claim 1, wherein the at least one recess and opening is radiated.

3. The bag melting device according to claim 1, wherein the stripping plate includes radially extending segments that are separated from each other by spacing gaps and linked together at least at their radial outer edge.

4. The bag melting device according to claim 1, wherein the restoring element encompasses a resilient material.

5. The bag melting device according to claim 1, wherein the restoring element is shaped generally identically to the at least one recess and opening.

6. The bag melting device according to claim 1, including a feed cone at a feed mouth of the cylindrical receiving area for a working material that can be ejected from the receiving area.

7. The bag melting device according to claim 1, wherein the radially outer stripping edge runs tightly and continuously around the stripping plate in an unstressed state.

* * * * *